US006595188B2

(12) United States Patent
Forck et al.

(10) Patent No.: US 6,595,188 B2
(45) Date of Patent: Jul. 22, 2003

(54) COMPACT VALVE ASSEMBLY AND FUEL INJECTOR USING SAME

(75) Inventors: Glen F. Forck, Peoria, IL (US); James J. Streicher, Pontiac, IL (US); Dana R. Coldren, Fairbury, IL (US)

(73) Assignee: Caterpillar Inc, Peoria, IL (US)

( * ) Notice: Subject to any disclaimer, the term of this patent is extended or adjusted under 35 U.S.C. 154(b) by 31 days.

(21) Appl. No.: 10/011,465

(22) Filed: Dec. 4, 2001

(65) Prior Publication Data

US 2003/0101967 A1 Jun. 5, 2003

(51) Int. Cl.[7] ..... F02M 2/00

(52) U.S. Cl. ..... 123/446; 123/447

(58) Field of Search ..... 123/446, 447, 123/467; 239/88–96

(56) References Cited

U.S. PATENT DOCUMENTS

| | | | | | |
|---|---|---|---|---|---|
| 4,211,202 | A | * | 7/1980 | Hafner | 123/457 |
| 4,948,049 | A | * | 8/1990 | Brisbon et al. | 239/96 |
| 4,979,674 | A | * | 12/1990 | Taira et al. | 123/467 |
| 5,441,029 | A | * | 8/1995 | Hlousek | 123/467 |
| 5,460,329 | A | * | 10/1995 | Sturman | 239/96 |
| 5,687,693 | A | * | 11/1997 | Chen et al. | 123/446 |
| 5,697,342 | A | | 12/1997 | Anderson et al. | |
| 5,720,261 | A | * | 2/1998 | Sturman et al. | 123/446 |
| 5,819,704 | A | * | 10/1998 | Tarr et al. | 123/467 |
| 6,012,644 | A | * | 1/2000 | Sturman et al. | 239/96 |
| 6,161,770 | A | * | 12/2000 | Sturman | 239/96 |
| 6,173,699 | B1 | | 1/2001 | Kasen | |
| 6,305,359 | B1 | * | 10/2001 | Kronberger et al. | 123/506 |

OTHER PUBLICATIONS

M. Brezonick, Lucasvarity's New Common Rail System, 4 pgs., Diesel Progress (30–34), Oct. 1998, USA.

N. Guerrassi and P. Dupraz, A Common Rail Injection System For High Speed Direct Injection Diesel Engines, 9 pgs., SAE 980803, Feb. 1998, Detroit, Michigan, USA.

U. Flaig, W. Polach and G. Zieger, Common Rail System (CR–System) for Passenger Car DI Diesel Engines; Experiences With Applications for Series Production Projects, 12 pgs., SAE 1999–01–0191, Detroit, Michigan, USA.

Bernd Mahr, Manfred Dürnholz, Wilhelm Polach, and Hermann Grieshaber, Robert Bosch GmbH, Heavy Duty Diesel Engines—The Potential of Injection Rate Shaping for Optimizing Emissions and Fuel Consumption Stuttgart, Germany, at the 21st International Engine Symposium, May 4–5, 2000, Vienna, Austria.

* cited by examiner

*Primary Examiner*—Thomas N. Moullis
(74) *Attorney, Agent, or Firm*—Liell & McNeil

(57) ABSTRACT

Inclusion of a direct control needle valve in fuel injectors can allow for independent control of injection pressure and timing. Engineers have learned that it is desirable to position the control valve assembly in close proximity to the needle valve member to improve response time. However, by placing the control valve assembly in a central portion of the fuel injector, at least one fluid passage must often be routed through the electrical actuator included in the valve assembly. The present invention seeks to address this problem by providing a direct control valve assembly for a fuel injector that directs fluid around the electrical actuator without increasing the size of the fuel injector. Thus, the present invention includes an electrical actuator having an actuator centerline that is oriented at an angle, which is preferably perpendicular, with respect to a centerline of the fuel injector.

20 Claims, 4 Drawing Sheets

COMPACT VALVE ASSEMBLY AND FUEL INJECTOR USING SAME

TECHNICAL FIELD

This invention relates generally to valve assemblies, and more particularly to fuel injectors having an electrically actuated valve positioned in a middle portion of the injector body.

BACKGROUND

Increasingly, fuel injectors are being equipped with direct control needle valves that are controlled in operation by a separate valve assembly to allow for independent control over injection characteristics, such as injection pressure and timing. Engineers have determined that for many applications it is beneficial to position the needle control valve assembly in close proximity to the direct control needle valve member. One example of such a fuel injector is disclosed in U.S. Pat. No. 5,697,342, which issued to Anderson et al. on Dec. 16, 1997. However, when the valve assembly is positioned in this more central portion of the fuel injector, it is problematic finding sufficient room to route fluid passages within the fuel injector around or through the valve assembly electrical actuator. This problem often results in undesirable compromises to accommodate the needed fluid passages around the electrical actuator, while maintaining performance requirements for the valve.

The present invention is directed to overcoming one or more of the problems as set forth above.

SUMMARY OF THE INVENTION

In one aspect of the present invention, a fuel injector includes an injector body that has a body centerline and provides a middle portion separating an upper portion from a lower portion. The injector body defines a fluid passage extending between the upper portion and the lower portion through the middle portion. An electrical actuator is attached to the injector body and is positioned in the middle portion. The electrical actuator has an actuator centerline. A valve member is positioned in the middle portion and is operably coupled to the electrical actuator. The valve member has a first position in which the fluid passage is open, and a second position in which the fluid passage is at least partially closed. The actuator centerline is oriented at an angle, which is greater than zero, with respect to the body centerline.

In another aspect of the present invention a valve assembly for positioning in a casing component includes a body component that has a body centerline and a top face that is separated from a bottom face by an annular side surface. The body component defines a fluid passage that extends from the top face to the bottom face. The top face and the bottom face provide at least one planar contact surface that is substantially perpendicular to the body centerline. An electrical actuator is attached to the body component away from the fluid passage. A valve member having a valve centerline oriented at an angle, greater than zero, with respect to the body centerline, is operably coupled to the electrical actuator, and is at least partially positioned in the body component. The valve member has a first position in which the fluid passage is open, and a second position in which the fluid passage is at least partially closed.

In yet another aspect of the present invention, a method of injecting fuel includes routing high pressure fuel to a nozzle chamber through a high pressure passage that is at least partially defined by a valve body component, but away from an electrical actuator that is attached to the valve body component. A needle valve member is moved to an open position, at least in part by relieving fluid pressure on a closing hydraulic surface of the needle valve member. The needle valve member is moved to a closed position, at least in part by resuming fluid pressure on the closing hydraulic surface of the needle valve member. At least one of the moving steps includes a step of energizing the electrical actuator to move a control valve member along a line oriented at an angle, greater than zero, with respect to a centerline of the needle valve member.

DETAILED DESCRIPTION

Figure 1:
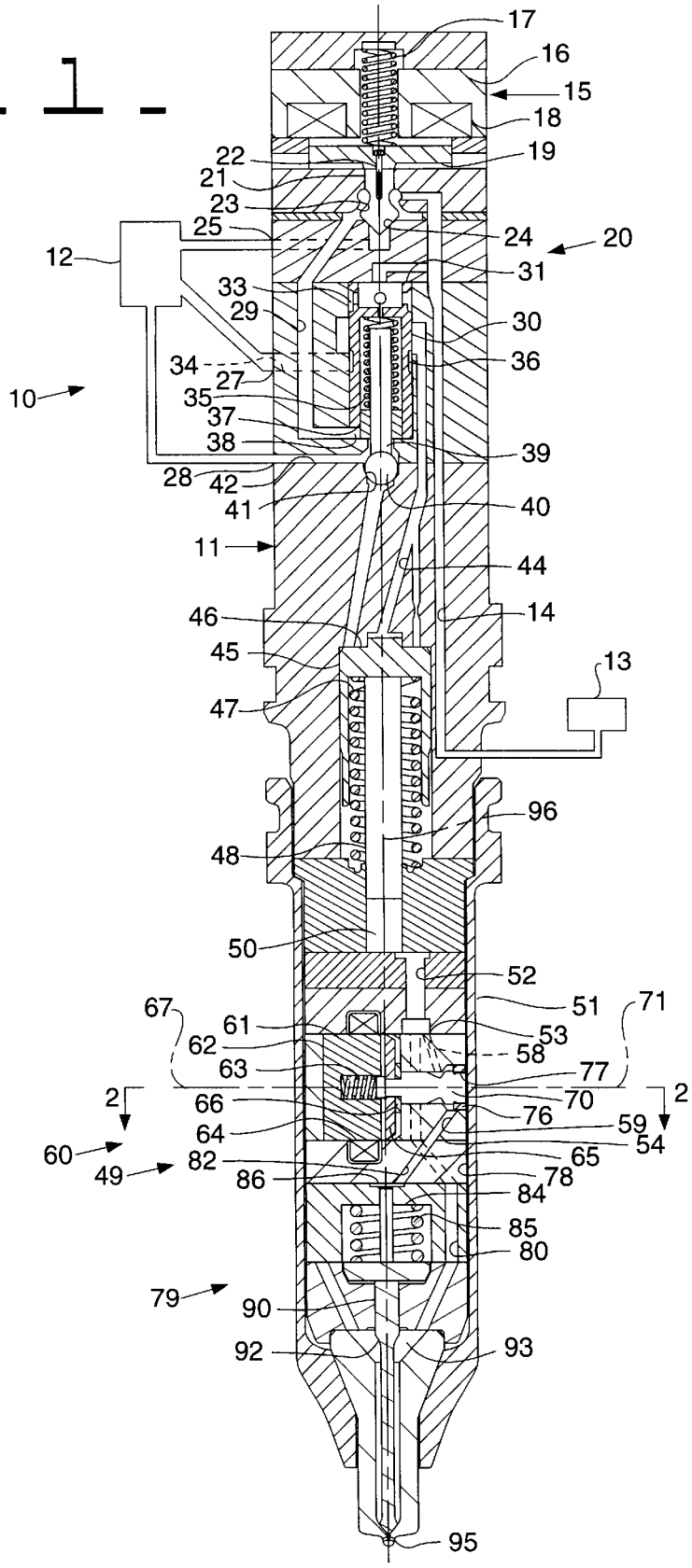
FIG. 1 is a sectioned side diagrammatic view of a fuel injector according to the present invention.

Referring now to FIG. 1 there is illustrated a fuel injector 10 according to the present invention. Fuel injector 10 has been illustrated as a hydraulically actuated electronically controlled fuel injector of the type manufactured by Caterpillar, Inc. of Peoria, Ill. However, it should be appreciated that the present invention could also be utilized in a mechanically actuated fuel injector or a common fuel rail type fuel injector. Fuel injector 10 consists of an injector body 11 made up of various components attached to one another in a manner well known in the art, and a number of movable internal parts positioned in the manner they would be just prior to the start of an injection event. As illustrated, injector body 11 has a middle portion 49 that separates an upper portion 20 from a lower portion 79. It should be appreciated that the three portions need not be similar in shape or size. Middle portion 49 has a top face 53 and a bottom face 54 that are separated by an annular side surface 51. A high pressure source 13 supplies fluid to a high pressure passage 14 defined by injector body 11 via a high pressure inlet. Preferably, high pressure source 13 contains an amount of pressurized engine lubricating oil, however, another suitable fluid could be used to actuate fuel injector 10, such as transmission fluid, fuel or coolant.

Fuel injector 10 is controlled in operation by a control valve assembly 15 that is preferably attached to injector body 11. Control valve assembly 15 includes an electrical actuator 16 that is preferably a solenoid. However, it should be appreciated that electrical actuator 16 could be another suitable device, such as a piezoelectric actuator. Electrical Actuator 16 includes a biasing spring 17, a coil 18, and an armature 19. A pilot valve member 21 is preferably attached to armature 19 via a fastener 22. Pilot valve member 21 is preferably a poppet valve member, as illustrated, however, another suitable valve member, such as a ball valve member could be substituted. When solenoid 16 is de-energized, armature 19 is held in its biased, advanced position by biasing spring 17, thus holding valve member 21 in its advanced position. When valve member 21 is in this position, it opens a high pressure seat 23 to allow fluid communication between high pressure passage 14 and a variable pressure passage 29 that is at least partially defined by injector body 11. When solenoid 16 is energized, armature 19 is moved to a retracted position against the bias of biasing spring 17, thus pulling valve member 21 toward its retracted position. When valve member 21 is in its retracted position, it closes high pressure seat 23 and opens a low pressure seat 24 thus blocking variable pressure passage 29 from high pressure passage 14 and opening the same to a low pressure drain 25.

A spool valve member 30 is also positioned in injector body 11 and is movable between an upward, retracted position as shown, and a downward, advanced position. Spool valve member 30 is biased toward its retracted position by a biasing spring 35. Spool valve member 30 defines a high pressure annulus 33 that is always open to high pressure passage 14 and is positioned such that it can open an actuation fluid passage 44 to high pressure passage 14 when spool valve member 30 is in its advanced position. A low pressure annulus 36 is also provided on spool valve member 30 that can connect actuation fluid passage 44 to a low pressure drain 27 via a low pressure passage 34 defined by injector body 11 when spool valve member 30 is in its retracted position as shown. Spool valve member 30 has a control surface 37 that is exposed to fluid pressure in a spool cavity 38 that is in fluid communication with variable pressure passage 29, and a high pressure surface 31 that is continuously exposed to high pressure in high pressure passage 14 via a number of radial passages that are defined by spool valve member 30. Preferably, high pressure surface 31 and control surface 37 are about equal in surface area.

When variable pressure passage 29 is fluidly connected to high pressure source 13, such as when pilot valve member 21 is in its retracted position, pressure within spool cavity 38 is high and spool valve member 30 is preferably hydraulically balanced and maintained in its retracted position by biasing spring 35. When spool valve member 30 is in this position, actuation fluid passage 44 is blocked from fluid communication with high pressure passage 14 but fluidly connected to low pressure passage 34 via low pressure annulus 36. Conversely, when variable pressure passage 29 is fluidly connected to low pressure reservoir 12, such as when pilot valve member 21 is in its advanced position, pressure within spool cavity 38 is sufficiently low that the high pressure acting on high pressure surface 31 can overcome the force of biasing spring 35, and spool valve member 30 can move to its advanced position. When spool valve member 30 is in this advanced position, actuation fluid passage 44 is blocked from low pressure passage 34 but high pressure fluid can flow into actuation fluid passage 44 via high pressure annulus 33 and high pressure passage 14.

An intensifier piston 45 is positioned in injector body 11 and includes a hydraulic surface 46 that is exposed to fluid pressure in actuation fluid passage 44. Piston 45 is biased toward a retracted, upward position by a biasing spring 47. However, when pressure within actuation fluid passage 44 is sufficiently high, such as when it is open to high pressure passage 14 via high pressure annulus 33, piston 45 can move to an advanced, downward position against the action of biasing spring 47. A plunger 48 is also movably positioned in injector body 11 and moves in a corresponding manner with piston 45. When piston 45 is moved toward its advanced position, plunger 48 also advances and acts to pressurize fuel within a fuel pressurization chamber 50 that is connected to a fuel inlet past a check valve (not shown). During an injection event as plunger 48 moves toward its downward position, the check valve is closed and plunger 48 can act to compress fuel within fuel pressurization chamber 50. When plunger 48 is returning to its upward position, fuel is drawn into fuel pressurization chamber 50 past the check valve. Fuel pressurization chamber 50 is fluidly connected to a fuel supply passage 52 that is defined at least in part by upper portion 20 and/or middle portion 49 of injector body 11. As illustrated, fuel supply passage 52 passes through both a top face 53 and a bottom face 54 of middle portion 49. Pressurized fuel contained within fuel supply passage 52 is supplied to both a nozzle supply passage 80 and a needle control passage 82. Fuel supply passage 52 is fluidly connected to needle control passage 82 via a upper portion 58 and lower portion 59.

Returning to fuel injector 10, a pressure relief valve 40 is movably positioned in injector body 11 to vent pressure spikes from actuation fluid passage 44. Pressure spikes can be created when piston 45 and plunger 48 abruptly stop their downward movement due to the abrupt closure of nozzle outlets 95. Because pressure spikes can sometimes cause an uncontrolled and undesirable secondary injection due to an interaction of components and passageways over a brief instant after main injection has ended, a pressure relief passage 42 extends between actuation fluid passage 44 and a low pressure vent 28. When spool valve member 30 is in its downward position, such as during an injection event, a pin 39 holds pressure relief ball valve member 40 downward to close a seat 41. When pressure relief valve 40 is in this position, actuation fluid passage 44 is closed to pressure relief passage 42 and pressure can build within actuation fluid passage 44. However, immediately after injection events, when piston 45 and plunger 48 are hydraulically slowed and stopped, residual high pressure in actuation fluid passage 44 can act against pressure relief valve 40. Because pressure within spool cavity 38 is high, spool valve member 30 is hydraulically balanced and can move toward its upward position under the action of biasing spring 35. Pressure relief valve 40 can then lift off of seat 41 to open actuation fluid passage 44 to pressure relief passage 42, thus allowing pressure within actuation fluid passage 44 to be vented. At the same time, upward movement of pressure relief valve 40, and therefore pin 39 can aid in the movement of spool valve member 30 toward its upward position.

Figure 2:
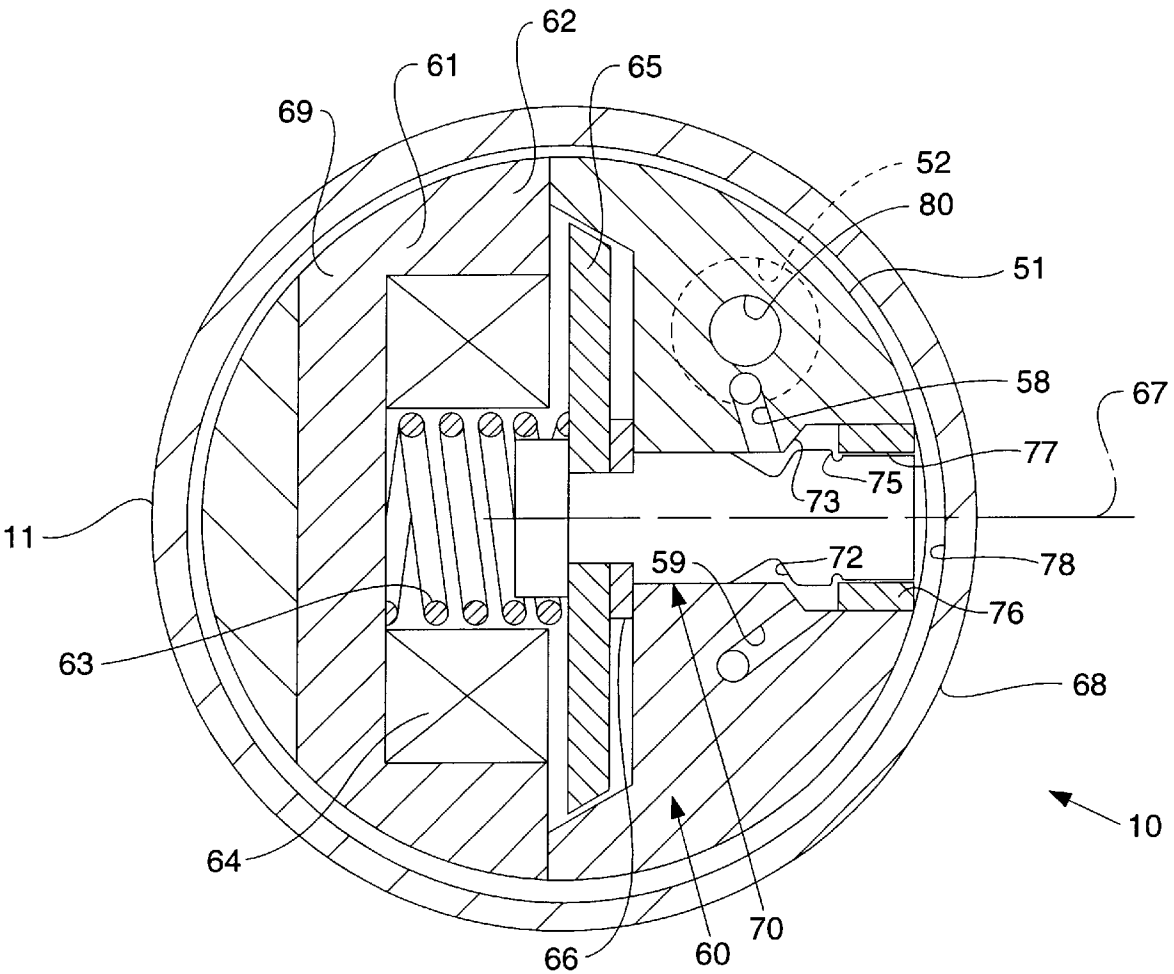
FIG. 2 is a sectioned top view of the valve assembly of the fuel injector of FIG. 1 as viewed along section line 2—2.

Referring in addition to FIG. 2, fuel injector 10 also includes a valve assembly 60 that provides an electrical actuator 61 and a valve member 70. Valve member 70 is preferably at least partially positioned in a casing component 68 provided by fuel injector 10. Preferably, electrical actuator 61 is an E-frame solenoid 62 that provides an E-frame stator 69. However, it should be appreciated that other electrical actuators, such as a piezoelectric actuator, a voice coil, or another suitable device, could instead be substituted. Solenoid 62 is positioned in injector body 11 such that an actuator centerline 67 is oriented at an angle, greater than zero, with respect to injector body centerline 96. Preferably, solenoid 62 is positioned such that actuator centerline 67 is about perpendicular to injector body centerline 96, as best illustrated in FIG. 1. When solenoid 62 is oriented as such, fluid passage 52 can be spacially separated from the various components of solenoid 62. Solenoid 62 includes a coil 64 and an armature 65. Armature 65 is limited in its movement by a spacer 66 and is coupled to move with valve member 70. Armature 65 can be attached to valve member 70 as illustrated, or these components could be unattached but coupled to move together, such as by a biasing spring. As with solenoid 62, valve member 70 is positioned such that a valve centerline 71 is oriented at an angle, greater than zero, with respect to injector body centerline 96. Preferably, valve member 70 is positioned such that valve centerline 71 and injector body centerline 96 are perpendicular, as best illustrated in FIG. 1.

When solenoid 62 is de-energized, such as between injection events, armature 65 is maintained in its biased, advanced position by a biasing spring 63 that is provided by valve assembly 60, thus holding valve member 70 in its advanced position, as illustrated in FIG. 2. When valve member 70 is in this position, a conical valve surface 72 included on valve member 70 is away from a conical high pressure seat 73 defined by injector body 11, such that an upper portion 58 is fluidly connected to a lower portion 59. High pressure fuel can therefore flow from fuel pressurization chamber 50 into needle control passage 82 around valve member 70. When solenoid 62 is energized, such as just prior to an injection event, armature 65 is moved to a retracted position against the bias of biasing spring 63, thus pulling valve member 70 toward its retracted position. When valve member 70 is in this position, valve surface 72 closes high pressure seat 73, and upper portion 58 is blocked from lower portion 59, thus ending the flow of high pressure fuel from fuel pressurization chamber 50 to needle control passage 82. A low pressure seat 75, defined by a sleeve 76, is opened by the retracting movement of valve member 70 to open lower portion 59 to a low pressure space 78 via a low pressure passage 77 that connects to annular side surface 51.

Returning to fuel injector 10, a direct control needle valve member 90 (FIG. 1) is movably positioned in injector body 11 and includes an opening hydraulic surface 92 exposed to fluid pressure in a nozzle chamber 93 and a closing hydraulic surface 86 exposed to fluid pressure in needle control chamber 84. Nozzle chamber 93 is in fluid communication with nozzle supply passage 80, while needle control chamber 84 is in fluid communication with needle control passage 82. Needle valve member 90 is movable between an upward, open position and a downward, closed position and is biased toward its downward position by a biasing spring 85. When valve member 70 is in its advanced position, such as while fuel in fuel pressurization chamber 50 is being pressurized, high pressure fuel can act on closing hydraulic surface 86 such that needle valve member 90 is maintained in its downward, closed position. When valve member 70 is moved to its retracted position, needle control passage 82, and therefore needle control chamber 84, is blocked from high pressure and connected to a low pressure area inside casing 68. With high pressure no longer acting on closing hydraulic surface 86, needle valve member 90 can be lifted to its upward, open position by the force of pressurized fuel acting on opening hydraulic surface 92.

Closing hydraulic surface 86 and opening hydraulic surface 92 are preferably sized such that even when a valve opening pressure is attained in nozzle chamber 93, needle valve member 90 will not lift open when needle control chamber 84 is fluidly connected to fuel supply passage 52 via nozzle control passage 82. However, it should be appreciated that the relative sizes of closing hydraulic surface 86 and opening hydraulic surface 92 and the strength of biasing spring 85 should be such that when closing hydraulic surface 86 is no longer exposed to fluid pressure in fuel supply passage 52, a valve opening pressure acting on opening hydraulic surface 92 should be sufficient to move needle valve member 90 upward against the force of biasing spring 85 to open nozzle outlet 95. It should be further appreciated that the strength of biasing spring 85 should be such that needle valve member 90 will remain in its closed position when fuel pressure in nozzle chamber 93 is below a valve opening pressure, even when needle control chamber 84 is blocked from fuel supply passage 52.

Figure 3:
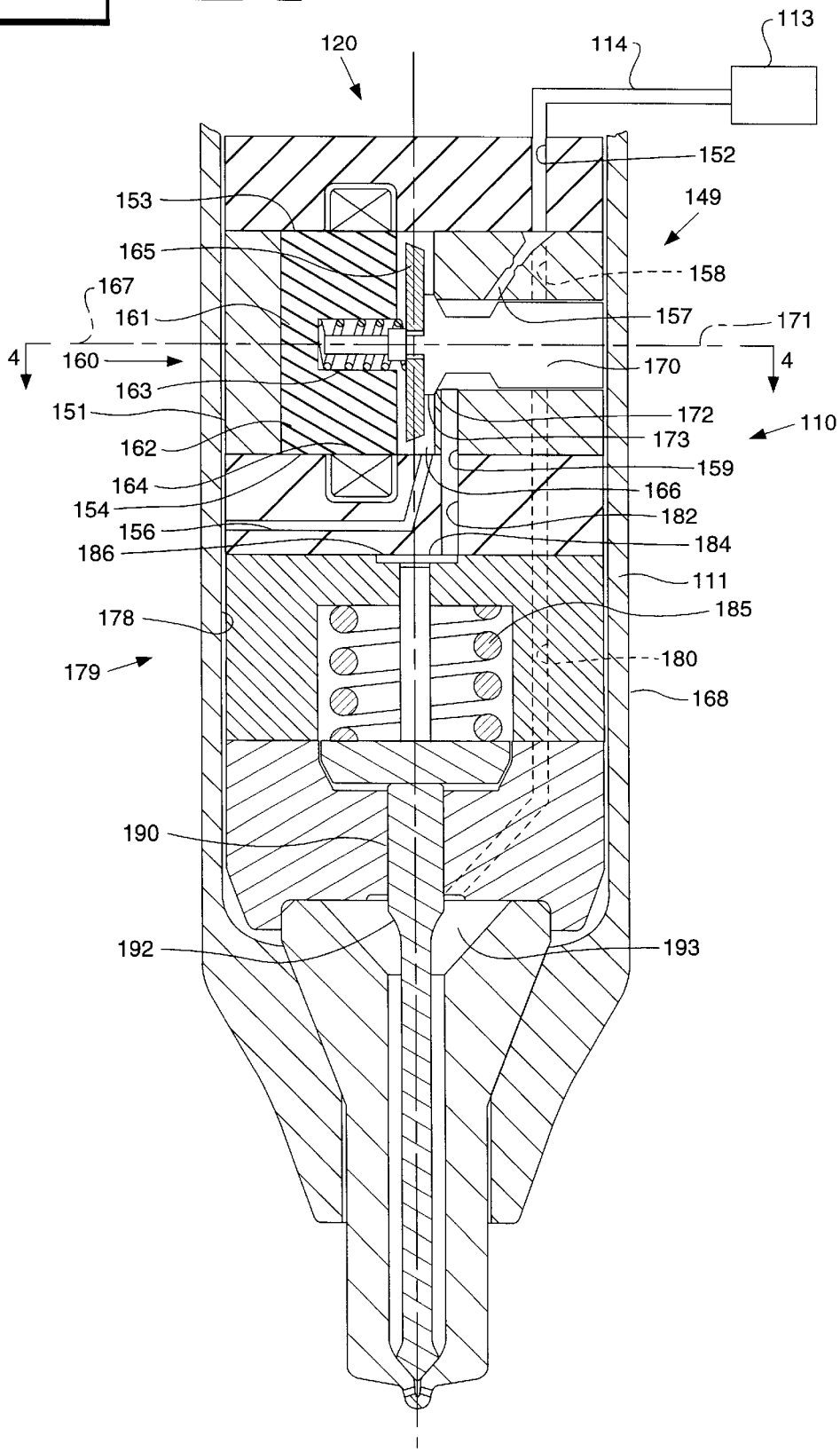
FIG. 3 is a sectioned side diagrammatic view of a fuel injector according to an alternate embodiment of the present invention.

Referring now to FIG. 3, there is illustrated a fuel injector 110 according to an alternate embodiment of the present invention. While fuel injector 10, illustrated in FIG. 1, included a means for pressurizing fuel to injection levels, fuel injector 110 is an electronically controlled nozzle, such as would be used with a common rail fuel injection system. Fuel injector 110 provides an injector body 111 that has an upper portion 120 and a lower portion 179 that are separated by a middle portion 149. As illustrated, middle portion 149 has a top face 153 and a bottom face 154 that are separated by an annular side surface 151. In addition, injector body 111 defines a fuel supply passage 152 that is fluidly connected to a source of pressurized fuel 113 via a fuel supply line 114. Thus, when fuel injector 110 is attached to a common rail, fuel supply passage 152 is continuously supplied with fuel that is pressurized to injection levels. Fuel injector 110 also includes a valve assembly 160 that is similar to valve assembly 60, previously disclosed. However, whereas valve assembly 60 can be referred to as a normally open valve assembly, or one in which valve member 70 is maintained in its advanced, or open, position between injection events, and is closed only when fuel injection is desired, valve assembly 160 could be referred to as a normally closed valve assembly. In other words, valve member 170 is maintained in a closed position until fuel injection is desired, and then moved to an open position at that time.

Figure 4:
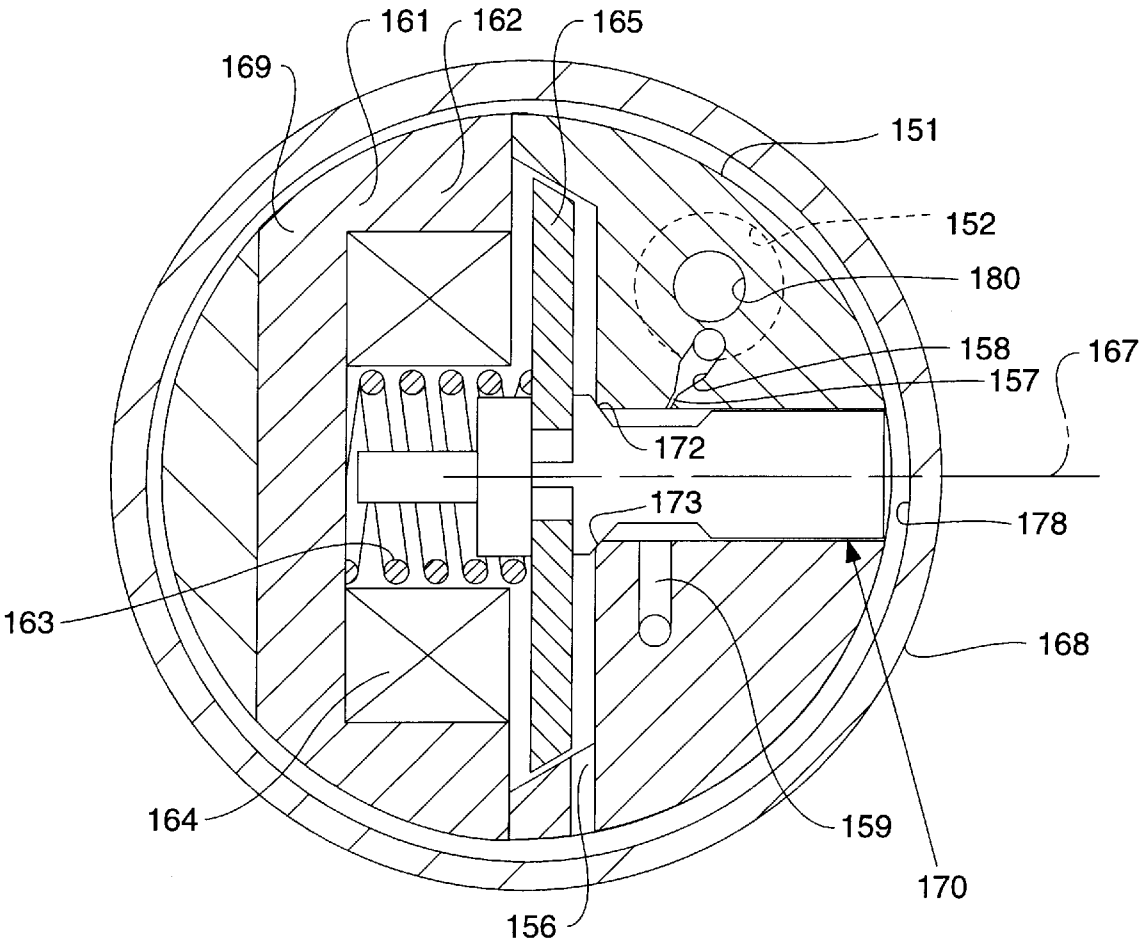
FIG. 4 is a sectioned top view of the valve assembly of the fuel injector of FIG. 3 as viewed along section line 4—4.

Referring now in addition to FIG. 4, valve assembly 160 provides an electrical actuator 161, which is preferably an E-frame solenoid 162 that has an E-frame stator 169. However, as with the previous embodiment, it should be appreciated that electrical actuator 161 could be any suitable device, such as a piezoelectric actuator or a voice coil. As with the previous embodiment, solenoid 162 is positioned within injector body 111 such that an actuator centerline 167 is oriented at an angle, greater than zero, with respect to an injector body centerline 196. Preferably, solenoid 162 is positioned such that actuator centerline 167 is perpendicular to injector body centerline 196. When solenoid 162 is oriented as such, fluid passage 152 can be spacially separated from the various components of solenoid 162. Solenoid 162 provides a coil 164 and an armature 165. Armature 165 is coupled to move with a valve member 170 that is at least partially positioned within a casing component 168. Armature 165 can be attached to valve member 170 as illustrated, or these components could be unattached but coupled to move together, such as by a biasing spring. As with solenoid 162, valve member 170 is positioned such that a valve centerline 171 is oriented at an angle, greater than zero, with respect to injector body centerline 196. Preferably, valve member 170 is positioned such that valve centerline 171 and injector body centerline 196 are perpendicular, as best illustrated in FIG. 3.

When solenoid 162 is de-energized, such as between injection events, armature 165 is maintained in its biased, advanced position by a biasing spring 163 provided by valve assembly 160, thus holding valve member 170 in an advanced, closed position. When valve member 170 is in this position, a conical valve surface 172 provided on valve member 170 is in contact with a conical valve seat 173 defined by injector body 111, such that an upper portion 158 is blocked from a low pressure passage 156. Pressurized fuel from fuel source 113 can flow through a flow restriction 157 into a needle control chamber 184 via a needle control passage 182. When solenoid 162 is energized, such as just prior to an injection event, armature 165 is moved to a retracted position against the bias of biasing spring 163, thus pulling valve member 170 toward a retracted, open position. When valve member 170 is in this position, valve surface 172 is moved away from valve seat 173, and lower portion 159 is fluidly connected to low pressure passage 156 via an armature cavity 166. Therefore, lower portion 159 and upper portion 158, via flow restriction 157, are opened to low pressure. Sizing flow restrictions on each side of valve member 170 can have a significant influence on performance.

Returning to fuel injector 110, a direct control needle valve member 190 (FIG. 3) is movably positioned in injector body 111 and includes an opening hydraulic surface 192 exposed to fluid pressure in a nozzle chamber 193 and a closing hydraulic surface 186 exposed to fluid pressure in needle control chamber 184. Nozzle chamber 193 is in fluid communication with nozzle supply passage 180, while needle control chamber 184 is in fluid communication with needle control passage 182. Needle valve member 190 is movable between an upward, open position and a downward, closed position and is biased toward its downward position by a biasing spring 185. When valve member 170 is in its advanced position, such as between injection events, high pressure fuel can act on closing hydraulic surface 186 such that needle valve member 190 is maintained in its downward, closed position. When valve member 170 is moved to its retracted position, such as just prior to the start of an injection event, needle control passage 182, and therefore needle control chamber 184, is opened to low pressure via armature cavity 166 and low pressure passage 156. With high pressure no longer acting on closing hydraulic surface 186, needle valve member 190 can be lifted to its upward, open position by the force of pressurized fuel acting on opening hydraulic surface 192.

It should be appreciated that the various passages and surfaces within injector 110 should be sized to allow fuel injector 110 to perform as desired. For instance, because upper portion 158 is opened to a low pressure area when valve member 170 is moved to its retracted, open position, flow restriction 157 should be small enough to prevent the depressurization of fuel in fuel supply passage 152 when valve member 170 opens valve seat 173. However, flow restriction 157 should be sized large enough that a sufficient amount of high pressure can be exerted on closing hydraulic surface 186 in needle control chamber 184 to maintain needle valve member 190 in its downward, closed position when valve member 170 is in its closed position. In addition, closing hydraulic surface 186 and opening hydraulic surface 192 are preferably sized such that needle valve member 190 will not lift open when needle control chamber 184 is fluidly connected to fuel supply passage 152 via nozzle control passage 182. However, it should be appreciated that the relative sizes of closing hydraulic surface 186 and opening hydraulic surface 192 and the strength of biasing spring 185 should be such that when closing hydraulic surface 186 is no longer exposed to fluid pressure in fuel supply passage 152, a valve opening pressure acting on opening hydraulic surface 192 should be sufficient to move needle valve member 190 upward against the force of biasing spring 185 to open nozzle outlet 195.

Industrial Applicability

Referring now to FIGS. 1 and 2, prior to an injection event, low pressure prevails in fuel injector 10, pilot valve member 21 is in its advanced position opening variable pressure passage 29 to high pressure passage 14 and spool valve member 30 is hydraulically balanced and positioned in its biased, retracted position fluidly connecting actuation fluid passage 44 to low pressure passage 34 such that low pressure is acting on hydraulic surface 46 of piston 45. Valve member 70 is in its biased advanced position opening needle control passage 82 to fuel supply passage 52 and needle valve member 90 is in its downward position closing nozzle outlet 95. Just prior to the desired start of the injection event, solenoid 16 is activated and valve member 21 is pulled to its retracted position by armature 19. Variable pressure passage 29 is now blocked from high pressure passage 14 and opened to low pressure drain 25.

With control surface 37 now exposed to low pressure in spool cavity 38 via variable pressure passage 29, spool valve member 30 is no longer hydraulically balanced. The high pressure acting on high pressure surface 31 is now sufficient to move spool valve member 30 to its advanced position. Actuation fluid passage 44 is thus blocked from fluid communication with low pressure passage 34 and opened to high pressure passage 14 via high pressure annulus 33. High pressure actuation fluid flowing into actuation fluid passage 44, acts on hydraulic surface 46 of piston 45, causing piston 45 and plunger 48 to begin to move toward their advanced positions to pressurize fuel in fuel pressurization chamber 50 and fuel supply passage 52. However, because closing hydraulic surface 85 is also exposed to high pressure in needle control chamber 84 via fuel supply passage 52 and needle control passage 82, needle valve member 90 will not be moved to its upward position to open nozzle outlet 95. Further, it should be appreciated that piston 45 and plunger 48 move only a slight distance at this time because of hydraulic locking, which is a result of nozzle outlet 95 remaining closed. However, the slight movement of piston 45 and plunger 48 is still sufficient to raise fuel pressure within fuel pressurization chamber 50 to injection pressure levels.

When injection is desired, solenoid 62 is activated and valve member 70 is pulled to its retracted position by armature 65. High pressure seat 73 is now closed by valve surface 72, thus ending fluid communication between needle control passage 82 and fuel supply passage 52. Needle control passage 82 is now opened to low pressure space 78 via low pressure passage 77 and fluid pressure acting on closing hydraulic surface 86 is relieved. With low pressure now acting on closing hydraulic surface 85 in needle control chamber 84 via needle control passage 82, needle valve member 90 can be lifted to its upward, open position by the force of pressurized fuel acting on opening hydraulic surface 192. Fuel in nozzle chamber 93 can now spray into the combustion space via nozzle outlet 95.

When the desired amount of fuel has been injected into the combustion space, solenoid 62 is de-energized. Valve member 70 is then returned to its biased, advanced position by biasing spring 63. As valve member 70 advances, high pressure seat 73 is reopened and needle control passage 82 is once again fluidly connected to fuel supply passage 52 to resume fluid pressure on closing hydraulic surface 86. With high pressure again acting on closing hydraulic surface 85, needle valve member 90 is returned to its downward, closed position blocking nozzle outlet 95 and ending the injection event. As a result of hydraulic locking, piston 45 and plunger 48 stop their advancing movement but do not immediately begin to retract because hydraulic surface 46 is still exposed to high pressure fluid in actuation fluid passage 44. It should be appreciated that if a split injection is desired, solenoid 62 would be re-energized and valve member 70 would be returned to its retracted position fluidly connecting needle control passage 82 to low pressure passage 77. With closing hydraulic surface 85 once again exposed to low pressure, and with high pressure still acting on opening hydraulic surface 92, needle valve member 90 would once again be moved to its open position.

Once the injection event has ended, the various components of fuel injector 10 reset themselves in preparation for the following injection event. Solenoid 16 is de-energized and valve member 21 is returned to its downward position under the force of biasing spring 17 to open high pressure seat 23. Variable pressure passage 29 is now open to high pressure passage 14, thus exposing control surface 37 is exposed to high pressure within spool cavity 38. With nozzle outlet 95 closed, residual high pressure in actuation fluid passage 44 is sufficient to move pressure relief valve 40 upward away from seat 41 to fluidly connect actuation fluid passage 44 to pressure relief passage 42. Pressure relief valve 40 can therefore help vent high pressure actuation fluid from actuation fluid passage 44 to prevent pressure spikes from causing undesired secondary injections. At the same time, the upward movement of pressure relief valve 40 causes pin 39 to aid spool valve member 30 in returning to its upward position. Recall that control surface 37 is again exposed to high pressure in spool cavity 38, causing spool valve member 30 to once again be hydraulically balanced such that it can return to its upward position under the force of biasing spring 35, in addition to the upward force of pin 39. When spool valve member 30 begins to retract, piston 45 and plunger 48 end their downward movement, however, as a result of hydraulic locking they do not immediately begin to retract. Once spool valve member 30 is returned to its upward position, actuation fluid passage 44 is blocked from fluid communication with high pressure passage 14 and fluidly connected to low pressure passage 34, which further reduces the pressure within actuation fluid passage 44. Piston 45 and plunger 48 can now move toward their retracted positions. As plunger 48 retracts, fuel can be drawn into fuel pressurization chamber 50 past the check valve 87.

Referring now to the FIGS. 3 and 4 embodiment of the present invention, prior to an injection event, fuel supply passage 152 is fluidly connected to pressurized fuel source 113, valve member 170 is in its advanced position blocking fuel supply passage 152 from low pressure space 178 and needle valve member 190 is in its downward position blocking nozzle outlet 195. Just prior to the desired start of injection, solenoid 162 is energized and valve member 170 is pulled to its retracted position by armature 165. Fuel supply passage 152 is now fluidly connected to low pressure space 178 via armature cavity 166 and low pressure passage 156. With low pressure now acting on closing hydraulic surface 186 in needle control chamber 184, needle valve member 190 is lifted to its upward position by the force of pressurized fuel acting on opening hydraulic surface 192. Fuel spray into the combustion space via nozzle outlet 195 can now commence.

When the desired amount of fuel has been injected into the combustion space, solenoid 162 is de-energized and valve member 170 is returned to its advanced position by biasing spring 163. When valve member 170 is moved to its advanced position, valve surface 172 closes valve seat 173, thus blocking fuel supply passage 152 from low pressure space 178. High pressure once again acts on closing hydraulic surface 185 in needle control chamber 184 and needle valve member 190 is moved to its downward position blocking nozzle outlet 195 and ending the injection event.

It should be appreciated that a number of modifications could be made to the embodiments of the present invention that have been illustrated herein. For instance, while fuel injector 10 has been illustrated as a hydraulically actuated fuel injector, the present invention could also be utilized with a mechanically actuated fuel injector. For such an injector, plunger 48 would be driven downward to pressurize fuel within fuel pressurization chamber 50 by a rocker arm and tappet assembly. In addition, while the valve member and the electrical actuator have been illustrated as being oriented in the injector body such that the valve centerline and the electrical actuator centerline are perpendicular to the injector body centerline, this is not necessary. Instead the valve member and/or the electrical actuator could be positioned such that the valve centerline and/or the electrical actuator centerline are oriented at any angle greater than zero with respect to the injector body centerline. Further, it should be appreciated that the present invention could find application in any fuel injector having a fuel or fluid passage that must pass through the electrical actuator. Use of the present invention can allow the desired fluid passage to pass around the electrical actuator, rather than through it, while still providing for a compact injector body.

Although this invention is illustrated in the context of a hydraulically actuated unit injector as shown in commonly-owned U.S. Pat. No. 5,738,075, for example, one skilled in the art will recognize that this invention is equally applicable to other fuel systems such as the amplifier piston common rail system (APCRS) illustrated in the paper "Heavy Duty Diesel Engines—The Potential of Injection Rate Shaping for Optimizing Emissions and Fuel Consumption", presented by Messrs. Bernd Mahr, Manfred Durnholz, Wilhelm Polach, and Hermann Grieshaber; Robert Bosch GmbH, Stuttgart, Germany, at the 21$^{st}$ International Engine Symposium, May 4–5, 2000, Vienna, Austria. In this regard, while the present invention has been illustrated for use in fuel injectors having a high pressure passage extending through the injector body, it should be appreciated that the valve assembly could instead control fluid communication between the needle control chamber and a low pressure passage or a low pressure drain.

It should be understood that the above description is intended for illustrative purposes only, and is not intended to limit the scope of the present invention in any way. Thus, those skilled in the art will appreciate that other aspects, objects and advantages of this invention can be obtained from a study of the drawings, the disclosure and the appended claims.

What is claimed is:

1. A fuel injector comprising:

an injector body having a body centerline and including a middle portion separating an upper portion from a lower portion;

said injector body defining a fluid passage extending between said upper portion and said lower portion through said middle portion;

an electrical actuator being attached to said injector body and positioned in said middle portion, said electrical actuator having an actuator centerline;

a valve member being positioned in said middle portion and being operably coupled to said electrical actuator, said valve member having a first position in which said fluid passage is open and a second position in which said fluid passage is at least partially closed; and said actuator centerline being oriented at an angle, which is greater than zero, with respect to said body centerline.

2. The fuel injector of claim 1 including a biaser at least partially positioned in said middle portion and being operably coupled to said valve member to bias said valve member toward one of said first position and said second position.

3. The fuel injector of claim 1 wherein said fluid passage is spacially separated from said electrical actuator.

4. The fluid passage of claim 1 wherein said fluid passage has an upper portion above said valve member and a lower portion below said valve member;

said injector body defines an additional fluid passage;

said lower portion of said fluid passage being closed to said additional passage but open to said upper portion when said valve member is in said first position; and said lower portion of said fluid passage being open to said additional passage but closed to said upper portion of said fluid passage when said valve member is in said second position.

5. The fuel injector of claim 1 wherein said injector body includes a conical valve seat; and said valve member is in contact with said conical valve seat when in one of said first position and said second position.

6. The fuel injector of claim 1 wherein said actuator centerline is about perpendicular to said body centerline.

7. The fuel injector of claim 1 wherein said actuator includes a solenoid having an armature coupled to move with said valve member.

8. The fuel injector of claim 1 including a casing component; and said electrical actuator and said valve member being at least partially positioned within said casing component.

9. The fuel injector of claim 1 including a direct control needle valve having a closing hydraulic surface exposed to fluid pressure in said fluid passage.

10. A valve assembly for positioning in a casing component of a fuel injector comprising:

a body component having a body centerline and a top face separated from a bottom face by an annular side surface, said body component defining a fluid passage extending from said top face to said bottom face;

said top face and said bottom face including at least one planar contact surface substantially perpendicular to said body centerline;

an electrical actuator being attached to said body component away from said fluid passage;

a valve member having a valve centerline oriented at an angle, greater than zero, with respect to said body centerline, being operably coupled to said electrical actuator, and being at least partially positioned in said body component; and said valve member having a first position in which said fluid passage is open, and a second position in which said fluid passage is at least partially closed.

11. The valve assembly of claim 10 including a biaser operably coupled to said valve member to bias said valve member toward one of said first position and said second position.

12. The valve assembly of claim 10 wherein said fluid passage has an upper portion above said valve member and a lower portion be low said valve member;

said body component defines an additional fluid passage;

said lower portion of said fluid passage being closed to said additional passage but open to said upper portion when said valve member is in said first position; and said lower portion of said fluid passage being open to said additional passage but closed to said upper portion of said fluid passage when said valve member is in said second position.

13. The valve assembly of claim 12 wherein said additional passage opens through said annular side surface.

14. The valve assembly of claim 10 wherein said body component includes a conical valve seat; and said valve member is in contact with said conical valve seat when in one of said first position and said second position.

15. The valve assembly of claim 10 wherein said valve centerline is about perpendicular to said body centerline.

16. The valve assembly of claim 10 wherein said electrical actuator includes a solenoid having an armature attached to said valve member.

17. A method of injecting fuel, comprising the steps of:

routing high pressure fuel to a nozzle chamber through a high pressure passage at least partially defined by a valve body component but away from an electrical actuator attached to said valve body component;

moving a needle valve member to an open position, at least in part by relieving fluid pressure on a closing hydraulic surface of said needle valve member; and moving said needle valve member to a closed position, at least in part by resuming fluid pressure on said closing hydraulic surface of said needle valve member; and at least one of said moving steps including a step of energizing said electrical actuator to move a control valve member along a line oriented at an angle, greater than zero, with respect to a centerline of said needle valve member.

18. The method of claim 17 wherein at least one of said moving steps includes a step of routing high pressure fluid through a separate passageway at least partially defined by said valve body component, but away from said electrical actuator to a needle control chamber, which is partially defined by said closing hydraulic surface of said needle valve member.

19. The method of claim 17 wherein at least one of said moving steps includes a step of de-energizing said electrical actuator to allow a biaser to move said control valve member substantially perpendicular to said centerline of said needle valve member.

20. The method of claim 17 wherein at least one of said moving steps includes a step of de-energizing said electrical actuator; and one of said energizing step and said de-energizing step includes a step of fluidly connecting said needle control chamber to a low pressure passage that opens through a side surface of said valve body component.

* * * * *